US010927569B2

(12) United States Patent
Lauer

(10) Patent No.: US 10,927,569 B2
(45) Date of Patent: Feb. 23, 2021

(54) DOOR HANDLE AND DRIVE SUPPORT FOR AN ELECTROMAGNETIC DOOR LOCK

(71) Applicant: Uhlmann & Zacher GmbH, Waldbüttelbrunn (DE)

(72) Inventor: Andreas Lauer, Estenfeld (DE)

(73) Assignee: UHLMANN & ZACHER GMBH, Waldbuttelbrunn (DE)

( * ) Notice: Subject to any disclaimer, the term of this patent is extended or adjusted under 35 U.S.C. 154(b) by 280 days.

(21) Appl. No.: 15/888,742

(22) Filed: Feb. 5, 2018

(65) Prior Publication Data

US 2018/0155961 A1 Jun. 7, 2018

Related U.S. Application Data

(63) Continuation of application No. PCT/EP2016/068435, filed on Aug. 2, 2016.

(30) Foreign Application Priority Data

Aug. 5, 2015 (DE) ..... 102015112859.4

(51) Int. Cl.
*E05B 47/06* (2006.01)
*E05B 47/00* (2006.01)
*E05B 15/04* (2006.01)

(52) U.S. Cl.
CPC ..... *E05B 47/068* (2013.01); *E05B 15/04* (2013.01); *E05B 47/0012* (2013.01)

(58) Field of Classification Search
CPC .... E05B 47/068; E05B 47/0012; E05B 15/04; E05B 2015/0406; E05B 2015/0437; E05B 2047/002

(Continued)

(56) References Cited

U.S. PATENT DOCUMENTS 5,018,375 A * 5/1991 Tully ..... E05B 47/068 292/144
5,083,122 A 1/1992 Clark
(Continued)

FOREIGN PATENT DOCUMENTS

DE 19854454 C2 9/2000
DE 202009011110 U1 12/2009
(Continued)

OTHER PUBLICATIONS

European Patent Office. Office Action for application 16745485.9, dated Jul. 7, 2020. With machine translation.

*Primary Examiner* — Lloyd A Gall
(74) *Attorney, Agent, or Firm* — Yakov Sidorin; Quarles & Brady LLP

(57) ABSTRACT

A door handle for actuating a mortise lock of a door with an output shaft and a handle facing away from the door. The output shaft and the handle have a common rotation axis and are connected to one another via an electromechanical clutch. The output shaft has a recess, on the side facing the handle, dimensioned for a coupling element that is axially displaceable between open and closed positions with a motor, while the handle has a receptacle dimensioned to accommodate the coupling element opposite to the recess. The door handle is particularly reliable when the motor drives a coupling (auxiliary) shaft on which and/or in which at least one coil spring is disposed non-rotatably and coaxially with respect to the stator of the motor. The auxiliary shaft has at least one protrusion engaging in an intermediate space between two neighbored windings of the coil spring to displace the coil spring axially as a result of rotation of the auxiliary shaft. The coil spring engages with the coupling element to at least preload the coupling element, as a result (Continued)

of the axial displacement of the coil spring, in a direction corresponding to such displacement.

22 Claims, 5 Drawing Sheets

(58) Field of Classification Search
USPC ... 70/218, 222, 223, 277, 472, 278.1–278.3, 70/278.7, 279.1, 283.1, 280–283; 292/336.3, 347, DIG. 27
See application file for complete search history.

(56) References Cited

U.S. PATENT DOCUMENTS 5,628,216 A * 5/1997 Qureshi ..... E05B 47/0012 292/201
6,041,630 A * 3/2000 Shen ..... E05B 13/101 70/149
6,460,903 B1 10/2002 Ming-Chih
6,640,594 B1 11/2003 Yao
9,181,730 B1 * 11/2015 Peng ..... E05B 47/0012
9,303,433 B2 * 4/2016 Chiou ..... E05B 49/00
9,316,025 B2 * 4/2016 Lien ..... E05B 47/0012
10,422,162 B2 * 9/2019 Uhlmann ..... E05B 13/005
10,465,423 B2 * 11/2019 Wong ..... E05B 47/0657
2009/0277232 A1 11/2009 Walsh
2010/0122561 A1 * 5/2010 Lui ..... E05B 47/0673 70/277
2012/0006082 A1 * 1/2012 Peng ..... E05B 47/068 70/277
2013/0043751 A1 2/2013 Yuan
2015/0300048 A1 * 10/2015 Yen ..... E05B 47/0012 292/144

FOREIGN PATENT DOCUMENTS

DE 102009018471 A1 1/2011
DE 102014103666 B4 11/2015
EP 1522659 B1 12/2006
EP 1881135 A1 1/2008
EP 1662076 B1 10/2008
EP 2664736 A2 11/2013
WO 1998015703 A1 4/1998
WO 2011119097 A1 9/2011
WO 2015140180 A1 9/2015

* cited by examiner

DOOR HANDLE AND DRIVE SUPPORT FOR AN ELECTROMAGNETIC DOOR LOCK

CROSS-REFERENCE TO RELATED APPLICATIONS

This application is a continuation of pending International Application No. PCT/EP2016/068435 filed on Aug. 2, 2016, which designates the United States and claims priority from the German Application No. 10 2015 112 859.4 filed on Aug. 5, 2015. The disclosure of each of the above-identified patent applications is incorporated herein by reference.

BACKGROUND

1. Field of the Invention

The invention relates to a door handle and/or a knob that are configured to actuate a locking cylinder and that serve or operate to actuate a case lock of a door. The door handle has an output shaft and a handle disposed, in operation, to face away from the door. The output shaft and the handle have a common rotational axis and are operably connected to each other via an electromechanical clutch. The output shaft has a recess, on the side facing towards the door handle, dimensioned for accepting a coupling element that is axially displaceable by a motor between an open position and a closed position; and the handle has a receptacle opposite to the recess for the coupling element.

2. Description of Relevant Art

A door handle, also referred to as a door knob, is a lever-type device for opening and closing the latch of a door. Thereby, the door handle acts via a shaft, usually a square shaft, on the so-called pusher nut, shortly 'nut' of a mortise lock (cf. e.g. DIN 18 251). A door handle usually has two legs or portions: a first leg, the longitudinal axis of which mostly (i.e. preferably) coincides with the rotational axis of the pusher nut, and a second leg, that is attached at an angle to the first leg. The second leg acts or operates as a lever. To actuate the door handle, the second leg is pivoted about the longitudinal axis of the first leg and rotates the first leg accordingly. Usually, the first leg is significantly shorter than the second leg.

Locking or releasing the door is usually done with the so-called cylinder locks, which are inserted in the mortise locks. A cylinder lock has a locking cam arranged on a shaft and interacting with the mortise lock. The locking cylinder enables a rotation of the locking cam upon given authorization of the user. Either a key or a knob serves for actuating the locking cam. Electromechanical locking systems are based on electronic identification of a key. The key may be, for example, an active or passive transponder. In operation, a lock control exchanges data with the key, checks the authorization of the key, and releases the lock if necessary. To release the lock at electromagnetic locking cylinders, the locking cam must be connected (operably coupled) with a handle (such as the knob) in a torque-proof manner, where the coupling between the two parts transmits a rotation of one of the parts to another of the parts. In the non-released state, at least the handle arranged on the outside of the door is not connected to the locking cam in a torque-proof manner (that is, the handle is then decoupled from the locking cam). To shift between the coupled and the decoupled lock bit, a coupling element or component, which is shiftable from the lock control, is required. Such coupling on the one hand must be so small (minimally dimensioned) that it can be integrated into a locking cylinder, and on the other hand the coupling element must be configured to absorb relatively high torques, to facilitate and/or enable the opening of the stiff lock (e.g., a clamping lock). The energy required for the operation is usually supplied by batteries, so the energy consumption by the coupling for closing and opening processes must be as low as possible.

A clutch may be understood as a coupling (element) that can be opened and closed, selectively. In the open state of such coupling element, the handle is freely rotatable relative to the output shaft and, as a result, the door cannot be opened by rotating the handle. In the closed state of the clutch, however, the handle and the output shaft are non-rotatably connected to each other (which configuration is interchangeably referred to as torque-proof connection), therefore the door can be opened in response to the handle being rotated. Shifting the clutch between these two states ('closed' and 'open') is preferably carried out electromechanically, for example with the use of a lock control that operates to shift the clutch between these two states.

U.S. Pat. No. 6,460,903 B1 discloses a door lock with an inner knob and an outer knob, which act/operate on a door latch. The inner knob is constantly connected with the door latch via an output shaft, such that the door latch can be retracted by a rotation of the inner knob at any time, i.e. independently from actuation of the clutch. The outer knob has a ring element that is non-rotatably connected with the corresponding handle, having a spur gearing in which a coupling ring can be inserted by means of a slider. The coupling ring has two radially arranged drive portions, each having two teeth that are operably complementary to the spur gearing. The driver wings are mounted axially displaceably in two slots of a connecting element, such that a rotation of the coupling ring is transmitted to the connecting element. The connecting element has a receptacle in which the output shaft is non-rotatably seated.

DE 198 54 454 C2 also describes an electronic door lock with two knobs that act/operate on a door latch. The inside knob constantly acts on the latch, the outside knob can be indirectly coupled with an output shaft of the inside knob.

To operate a latch of the mortise locks, that are widespread in use in Europe, none of the door knobs known from the US publications is suitable.

Alternatively, couplings are known that are arranged, under a cover, directly on the door leaf and that serve to connect a door handle to the nut of a mortise lock (EP 1662 076 B1, EP 1 881 135 A1, EP 1522659 B, DE 10 2009 018 471 A, U.S. Pat. No. 6,640,594 B1). For aesthetic reasons, however, these are only accepted to a limited extent.

DE 10 2014 103 666 describes a door handle with a shaft and a handle disposed orthogonally to the shaft for actuating the latch of a mortise lock. In the shaft, there is an output shaft component that is non-rotatably connectable with the handle by means of a clutch arranged in the door handle. When the clutch is open, the handle does not drive the shaft, and when the clutch is closed, the handle drives the shaft (if and when rotated). The clutch has a coupling element that is displaced in a space formed by two opposing recesses, in order to open and close the clutch. To displace the coupling element, the clutch has a linear drive with a control element being rotatably mounted and axially displaceable in the handle, which acts on the coupling element to displace it axially.

SUMMARY

Embodiments of the invention are configured to improve the door handle known from DE 10 2014 103 666 (incorporated herein by reference) to such effect and degree that such door handle can be manufactured at lower costs and furthermore works more reliable.

In an embodiment, the actuating element 'door handle' serves to actuate a latch and/or a dead bolt of a mortise lock and, accordingly, has a door-facing output shaft and a handle facing away from the door. The output shaft and the handle have a common rotational axis and are connected to each other via an electromechanical clutch. The output shaft can usually be operably connected to the nut of a mortise lock and/or to a locking cam ring of a cylinder lock (for example, via a square shaft). The handle is configured and serves to pivot the actuating element about a rotational axis. The actuating element may, for instance, a door handle or a knob module of a cylinder lock.

The clutch has an axially displaceable coupling element. On a side facing towards the handle, the output shaft has a recess dimensioned to receive a coupling element or slide when the coupling element is axially displaced between an open position and a closed position by means of a motor. Opposite to such recess, the handle has a receptacle configured for the coupling element. Preferably, the output shaft is not exposed, but is covered either by a rosette and/or a part of the handle, such that it cannot be rotated when the clutch is open.

The recess and the receptacle usually have limited rotational symmetry (or no rotational symmetry at all), and the coupling element has a shape that is adapted to the shape(s) of the recess and the receptacle, such that the coupling is closed when the coupling slide or element engages both the recess and the receptacle. Then a rotationally positive form-fit is generated. The receptacle of the handle may be also configured as a recess (and only for easy differentiation the term receptacle is linguistically distinguished from the recess of the output shaft). Alternatively, one could also refer to the output shaft recess and the handle receptacle as a first recess and a second recess. Of course, one could also invert the receptacle (and/or the recess). Then the coupling slide or element would have corresponding recesses which would be slid on the receptacle and the (possibly inverted) recess.

Preferably, a linear drive is arranged in the handle. The linear drive acts on the coupling element as follows: (i) to close the clutch, the linear drive displaces the coupling element in the axial direction as far out of the recess as to have the coupling element engage both in the output shaft recess and in the handle receptacle; (ii) to open the clutch, the linear drive displaces the coupling element from the receptacle back into the recess. Such configuration of a clutch is very reliable, compact and can transmit also high torques with little use of material. In addition, this clutch can be arranged or disposed in a very narrow shaft, i.e. in a narrowly dimensioned leg, of a door handle, that is closer to the doorleaf when installed on the door (the door-side leg of the a door handle). The door handle possessing the so-configured clutch can, therefore, be designed correspondingly slim, and may visually not necessarily differ from the usual rigid door handles that do not contain a clutch. Also, if the actuating element is a knob module for a cylinder lock, the dimensionally-slim design is preferred, as with this slim design a reduction of the door mandrel becomes possible.

Preferably, the motor drives a coupling shaft (hereafter referred to as 'shaft' or "auxiliary shaft" or "coupling shaft"), on and/or in which at least one coil spring is arranged coaxially and non-rotatably relative to the stator of the motor. The term "non-rotatably" as used here means that the coil spring does not rotate with a rotation of the motor-driven auxiliary shaft. Of course, when the doorknob is turned, the (auxiliary) shaft can rotate with the doorknob. The spring is preferably arranged to be axially displaceable on and/or in the (auxiliary) shaft. Preferably, a protrusion of the shaft engages in an intermediate space between two turns of the coil spring. Upon rotation of the shaft, the protrusion slides along the turns like a nut on the thread of a screw, whereby the coil spring is accordingly displaced, or in any case at least becomes pre-loaded. The coil spring, in turn, preferably engages directly with the coupling element. For example, the coil spring may be mounted to the coupling element. A rotation of the (auxiliary) shaft thus causes a translational movement or at least pre-loading of the coupling element in the direction corresponding to the rotation. In advantageous comparison to the clutch known from DE 10 2014 103 666, the coupling slide discussed there is omitted. The coupling configuration is thus simpler and therefore more robust, because in the same assembly space fewer parts must be accommodated. Accordingly, these can therefore be carried out more robustly.

If, for example, the linear drive is arranged in the handle, the coupling element (when the clutch is open) could be pulled out as far out of the recess of the output shaft that the handle is rotatable against the output shaft. With the rotation of the auxiliary shaft, the coil spring can now be displaced in the direction of the output shaft and caused to push the coupling element in the same direction. If or as soon as the recess is aligned to match with the receptacle in the handle, a part of the coupling element is shifted, i.e. moved to engage into the recess. The clutch is closed. To open the clutch, the auxiliary shaft is rotated in the opposite direction. Accordingly, the coil spring moves backwards. Thereby, the coil spring either pushes or pulls the coupling element mounted to the coil spring. (In other words, the coil spring and the coupling element are cooperated with one another in a push-pull manner, when a movement of the coil spring effectuates either a pushing or a pulling of the coupling element.) Alternatively or in addition, a return spring may be positioned in the handle recess to push the coupling element out of the recess. The return spring is thus pre-loaded when the coupling element is inserted into the recess. If the coupling element transmits a torque between the output shaft and the handle while the shaft rotates, the coupling element is usually clamped, i.e. jammed, in its position and cannot be moved axially. In this case, the coil spring would be displaced in the corresponding direction, thereby being pre-loaded and thus preloading the coupling element in the corresponding direction; the coupling element follows the coil spring as soon as it is released, i.e. as soon as it is no longer jammed. Alternatively, the linear drive can be arranged in or on the output shaft. In this case, the coupling element would be positioned in the recess while the clutch is open. When closing the clutch, the coupling element would be displaced axially until it engages in the recess and receptacle, at the same time.

For example, the actuating element, e.g. the door handle or the knob module, may have a drive carrier with a drive-carrier recess dimensioned to receive the shaft and the coil spring at least partially. As a result, a force-fitting drive module for the clutch can be provided very easily. Such a separate drive carrier can be pre-assembled with the corresponding components outside the actuating element and then be inserted into the actuating element. As a result, the assembly and an eventual repair work are significantly simplified.

If the drive carrier (also referred to as a drive block) is configured to have at least one slot running in the axial direction of the auxiliary shaft, into which at least one end of the coil spring engages, the coil spring is mounted in a very simple way in the drive carrier to be non-rotatable but axially displaceable. For example, at least one end of the coil spring may have an outwardly guided section with which the coil spring engages the slot. The engaging section may, e.g. be designed as a loop, whereby the risk of entanglement of the coil spring or possible abrasion is significantly reduced. Only for clarification purposes: the term "guided outwardly" means guided away from the longitudinal axis of the coil spring, e.g. pointing radially outwards.

The drive carrier or block may also have at least one bearing, e.g. have a plain bearing surface on which a complementarily mating surface of the coupling element slides (when it is adjusted in its position). Thereby, the coupling configuration can be embodied even more compactly.

Preferably, a gear wheel is non-rotatably, i.e. in a torque-proof manner, mounted on the shaft, i.e. upon rotation of the gear wheel, the shaft is entrained. This gear wheel enables driving of the shaft in an easy fashion and can furthermore be intercepted on an abutment of the drive carrier in the axial direction, such that the shaft is secured against axial displacement in the motor carrier. For example, the gear wheel may be received in a receptacle of the drive carrier, wherein at least a part of the boundary of such receptacle supports the gear wheel in axial direction. Particularly preferred, the boundary is the frontal edge of a bearing bush seated in the receptacle which bearing bush radially supports the shaft.

The assembly of the actuating element is greatly simplified by configuring the drive carrier (drive block) to contain at least two parts dimensioned to at least partially enclose and support the shaft. When these two parts are separated or released from each other, the drive carrier is effectively opened and the shaft can be inserted (and secured in an intended position) or released/removed, for example in the axial direction.

In particular, at least one plain bearing bush can be seated in the drive carrier, which radially supports the shaft. In addition, the front face of the plain bearing bush can serve as axial bearing for the shaft and/or the gear wheel.

Preferably, at least one plain bearing sleeve is seated on the shaft. As a result, the shaft can be supported very easily radially and/or axially in two positions. For mounting, it is sufficient to put the plain bearing sleeve on the shaft, and subsequently a gear wheel can be mounted on the auxiliary shaft. Alternatively, the gear wheel and the plain bearing sleeve can be made in one piece. Subsequently, the so pre-assembled elongated torque-transmitting component can be easily inserted into a corresponding bearing bush of a drive carrier. By placing a second part of the drive carrier in the appropriate location, the component can be axially fixed in the required position.

For example, the auxiliary shaft may be dimensioned to be tapered (for example, tapered off) in a step-wise manner. With the step, it may abut at a front face of one of the plain bearing bushes, whereby the shaft is axially supported in the direction of the respective plain bearing bushing.

Preferably, the handle has a hollow shaft or tubular element, in which the output shaft and at least a part of the linear drive are accommodated. In a mounted configuration, the hollow shaft may face or point to the door in other words, it is closer to the door that the leg of the handle extending essentially parallel to the door leaf and in general at least essentially horizontal and which is usually gripped when pivoting the handle. As a result, the handle protects the output shaft against unauthorized access and a particularly compact overall design is possible. Particularly preferred is the configuration when the output shaft is rotatably mounted in the hollow shaft (or tubular element). Upon closing of the clutch, the rotation of the output shaft is of course blocked or at least limited.

For example, the handle may include a handpiece that is non-rotatably connected to the hollow shaft, with two legs arranged at an angle with respect to one another. The door handle then has the form of a conventional door knob. For mounting it is advantageous if the handpiece has at least two half-shells, between which at least one fastening section of the hollow shaft is arranged. For example, the half-shells may have an external thread on the side that is positioned closer to the door, and on this external thread a union nut is seated or disposed to fix the half-shells on the hollow shaft. The union nut should preferably be protected against unauthorized opening, e.g. be covered by a rosette or locked by a stop which is only reachable with disassembled door handle.

BRIEF DESCRIPTION OF THE DRAWINGS

In the following portion of the disclosure, the invention will be described by way of example, without limitation of the general inventive concept, and with reference to the drawings.

Figure 1A:
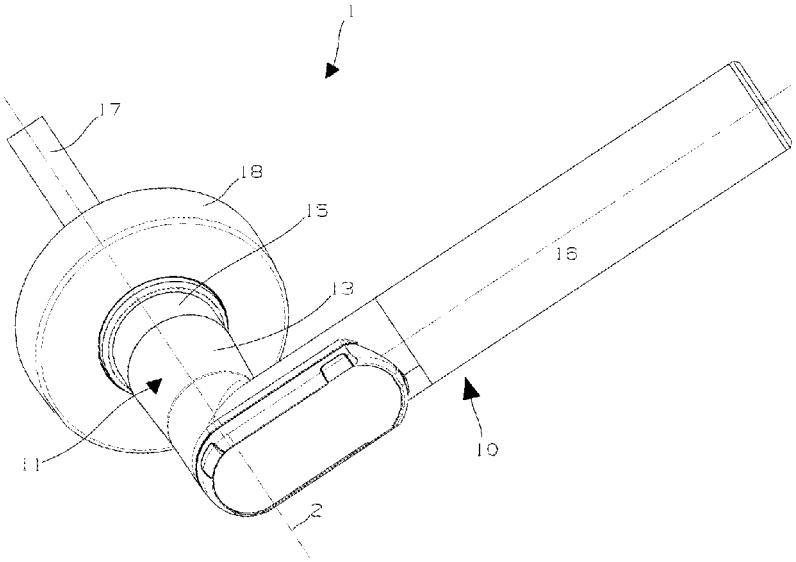
FIG. 1*a* shows a perspective view of an actuating element (door handle).

While the embodiment(s) of the invention can be variously modified and assume alternative forms, specific embodiments thereof are shown by way of example in the drawings and are described below in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

Figure 1B:
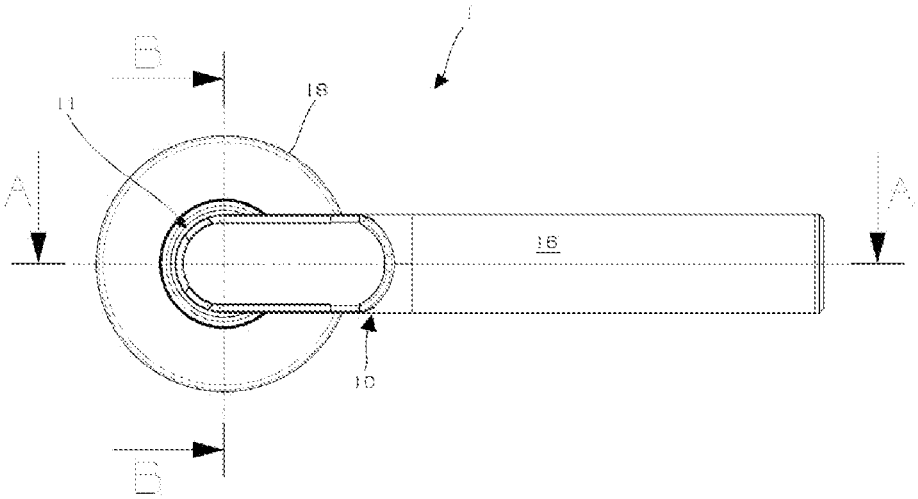
FIG. 1*b* shows the door handle of FIG. 1*a* in front view.

FIG. 1 shows an actuating element configured as (in a form of) a door handle 1. The door handle 1 has a handle portion ('handle", for short) 10 that is pivotable about a rotational axis 2, with a door-side (that is, positioned next to the door leaf, when the actuating element is mounted on the door) first leg 11. The longitudinal axis 2 of the first leg is oriented approximately orthogonally direction to a door leaf (which is not shown) when the element 1 is mounted on the door (i.e., in the mounted state). The handle also has a second leg 16 angled to (disposed at an angle with respect to) the first leg. The region in which the first and second legs meet at an angle includes two half-shells 13 being held together by a nut 15 on the side of the half-shells facing the door (on the door side) and a sleeve on the other side. As indicated in the Figure, the handle 1 may have a receptacle dimensioned for a square shaft portion 17 (which is a portion of the output shaft that has a substantially square cross-section), to non-rotatably couple the door handle with the nut, i.e. the follower, of a mortise lock. A rosette 18 may be provided to fasten and mount the door handle 1 to a door leaf and to protect the clutch (which will be described in more detail below) against being manipulated with. An output shaft is partially covered by the handle 10, and only the square shaft portion 17 of the output shaft is visible. Rotational movements of the output shaft about the longitudinal axis 2 can be introduced via the square shaft portion into the follower of a mortise lock (which received the square shaft and couples it with the actuation mechanism of the latch), whereas tilting movements act orthogonally with respect to the longitudinal axis 2 and are preferably largely intercepted by the bearing of the handle 10 through the rosette 18 and directed into the door leaf. A clutch controlled by a lock control is arranged between the handle 10 and the output shaft to non-rotatably connect the handle 10 to the output shaft 17 (in case when clutch is closed), or to decouple the handle 10 and the output shaft (in case the clutch is open). Preferably, the handle 10 rests on the rosette 18 via a return spring, thus the door handle 1 does not hang down when the clutch is open. The rosette 18 may preferably be bolted or otherwise be fastened to the door leaf from the inner side of the door.

Figure 2:
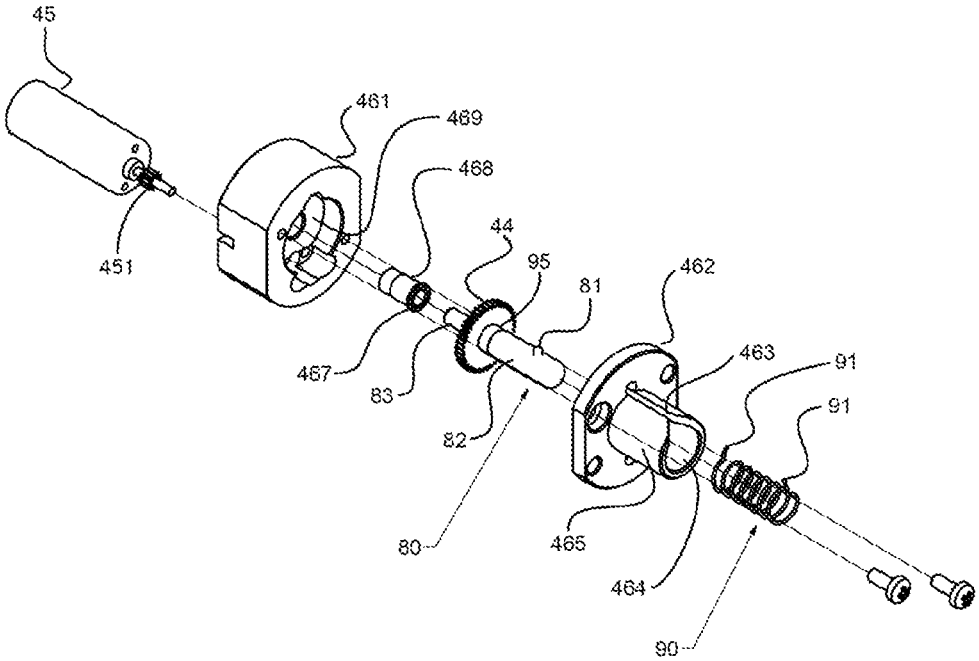
FIG. 2 shows an exploded view of a linear drive.
Figure 3:
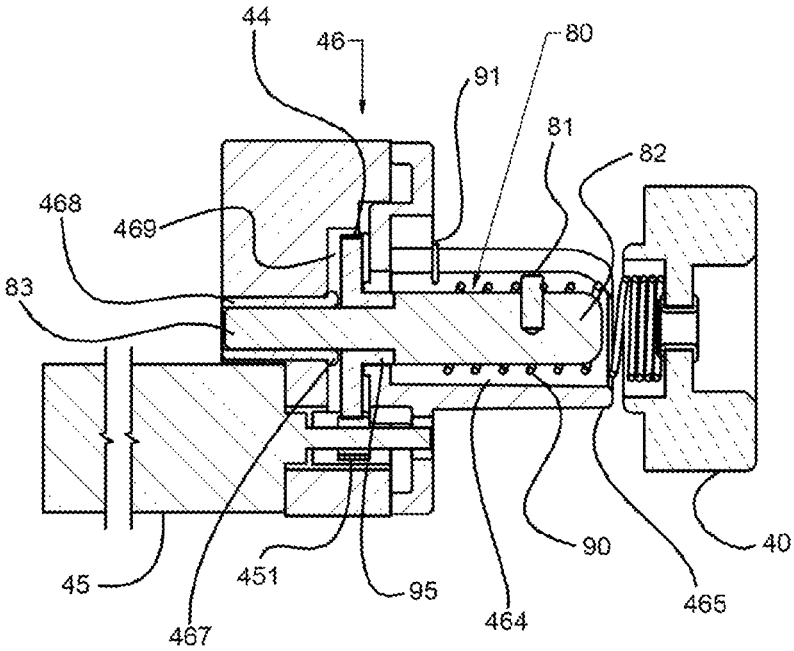
FIG. 3 shows a longitudinal section of the linear drive from FIG. 1.

FIGS. 2 and 3 show a linear drive for a coupling element 40. The linear drive employs a commercially available motor 45, which is attached to a two-part drive carrier 46, which can also be referred to as a gear block. The motor 45 drives a gear wheel 44, which sits non-rotatably on and is axially fixed to a coupling, auxiliary shaft 80 ('shaft 80', for short). This auxiliary shaft 80 is rotatably mounted in the drive carrier and secured against axial displacement. On the shaft 80 there is a drive pin 81 formed as a protrusion 81, which engages between two turns of a coil spring 90. The coil spring 90 is seated coaxially on a trunnion 82 of the shaft 80 and engages with one of the shaft's ends 91 in a slot 463 of the drive carrier 46, which slot 463 is parallel to the longitudinal axis of the shaft 80. At the other end, the coupling element 40 is mounted to the coil spring by a push-pull proof connection, i.e. an axial force is transmitted from the coil spring to the coupling element in each axial direction. A push-pull proof connection can be obtained, e.g., by means of a rivet attaching the coupling element 40 to an end of the coil spring. Due to the end 91 being engaged in the slot 463, the coil spring 90 is non-rotatably but axially displaceably seated in the drive carrier 46. If the auxiliary shaft 80 is now rotated by means of the motor 45, the protrusion 81 of the shaft 80 displaces the coil spring 90 further out of the drive carrier 46 in a fashion corresponding to the direction of rotation of the motor 45, or alternatively retracts the coil spring 90. The corresponding displacement of the coil spring 90 causes a corresponding displacement of the coupling element 40. If the coupling element 40 should be blocked, it would be pre-loaded in the corresponding direction and would release the pre-load bias as soon as the blockage is removed.

The protrusion 81 is preferably spaced apart from the open end of the channel 464, such that the free end of the spring 91 cannot be pushed out of the channel 464 and thus out of the slot 463. The distal free end of the shaft 80 also projects beyond the trunnion 82, such that the coil spring 90 remains on the shaft 80 even when the shaft 80 rotates until the protrusion 81 is threaded out of the coil spring 90. Upon reversal of the rotation direction of the shaft 80, the protrusion 81 thus automatically engages into the thread or guide provided by the coil spring 90.

The drive carrier 46 has two parts 461 and 462. On the first part 461, there is a support for the motor 45. In addition, the first part 461 may have a recess, in which preferably a bearing bush 468 with a flange-like widening 467 (shortly, 'flange 467' or 'edge bead 467') sits. The flange 467 preferably rests on the side that faces the protrusion 81. This side facing the protrusion can serve as a thrust bearing for the shaft 80. In the depicted example, the flange 467 supports the gear-wheel 44, which is seated on the shaft 80 in a friction- and/or form-fit manner. In other words, the side of the flange 467 facing the protrusion can serve as a thrust bearing for the shaft 80, which can be supported thereon by the gear-wheel 44.

The second part 462 of the drive carrier preferably has a bearing receptacle for the shaft 80. The bearing receptacle can be configured to support a bearing ring 95 seated on the shaft 80 (the bearing ring 95 also referred to as a bearing sleeve 95). In the example shown, the shaft 80 is expanded towards the trunnion 82 in a step. The bearing ring is located laterally at the step. The bearing ring 95 is axially fixed by the gear-wheel 44 attached to the shaft 80. Thus, for mounting the shaft 80, the bearing ring 95 is first pushed on the shaft 80 from the tapered side of the shaft 80 until the step is reached. The step, therefore, provides an axial abutment. Subsequently, the gear-wheel 44 is mounted on the shaft, e.g. pressed thereon. Now, the bearing pin 83 of the shaft 80 can be inserted into the bearing bush 468. Thereby, the gear-wheel 44 engages with a complementary drive pinion 451 of the motor 45. Alternatively, the motor 45 could also drive a worm gear which meshes with the gear-wheel 44. Now, the drive carrier 46 can be closed by placing the second part 462, whereby the gear-wheel is enclosed in a cavity 469, i.e. a corresponding receptacle 469 of the drive carrier 46.

The drive carrier 46 has a protrusion 465 in the form of a slotted sleeve 465, wherein the slot 463 extends towards the coupling element side. This facilitates easy threading of a free end 91 of the coil spring 90. The free interior of the protrusion 465, i.e. of the sleeve has previously been referred to as channel 464.

Figure 4:
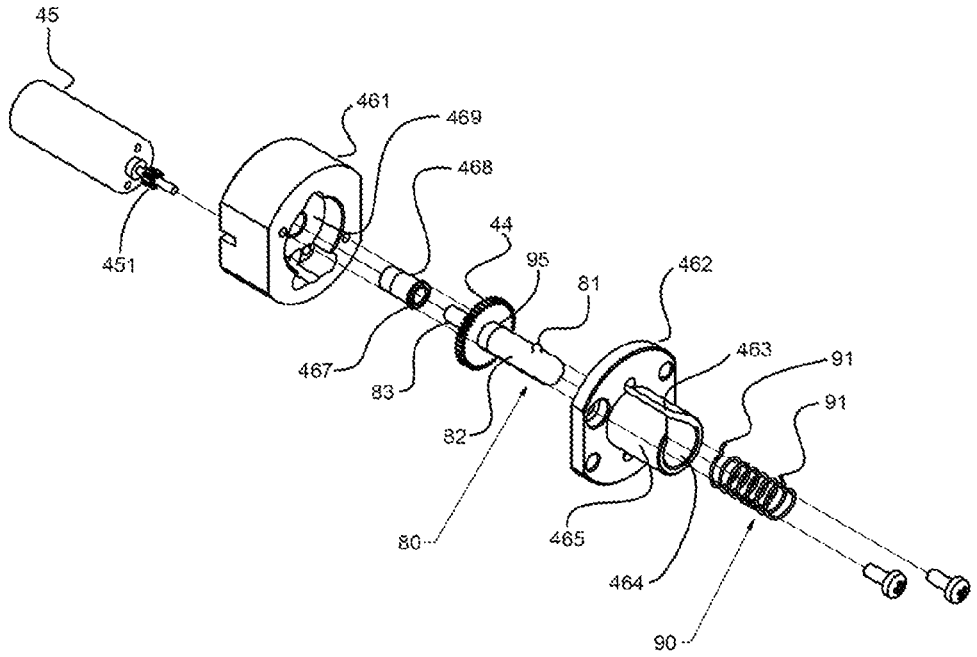
FIG. 4 shows an exploded view of a linear drive.

The embodiment of FIG. 4 differs from the embodiment of FIGS. 2 and 3 only in that the coil spring 90 is not attached on the coupling element, but only rests with the free end against the coupling element. Here, the coil spring 90 can therefore only transmit compressive forces to the coupling element 40, which is not shown in FIG. 4 for the sake of simplicity. A displacement of the coupling element 40 in the direction of the shaft 80 takes place by means of a spring element which is arranged on the side of the coupling element 40 facing away from the shaft and which spring element is tensioned into its closed position during the movement of the coupling element. By the widening of the slot 463 on the coupling element side it is ensured that the free end of the coil spring 90 can always be safely moved back in the sleeve-like protrusion 465.

Figure 5:
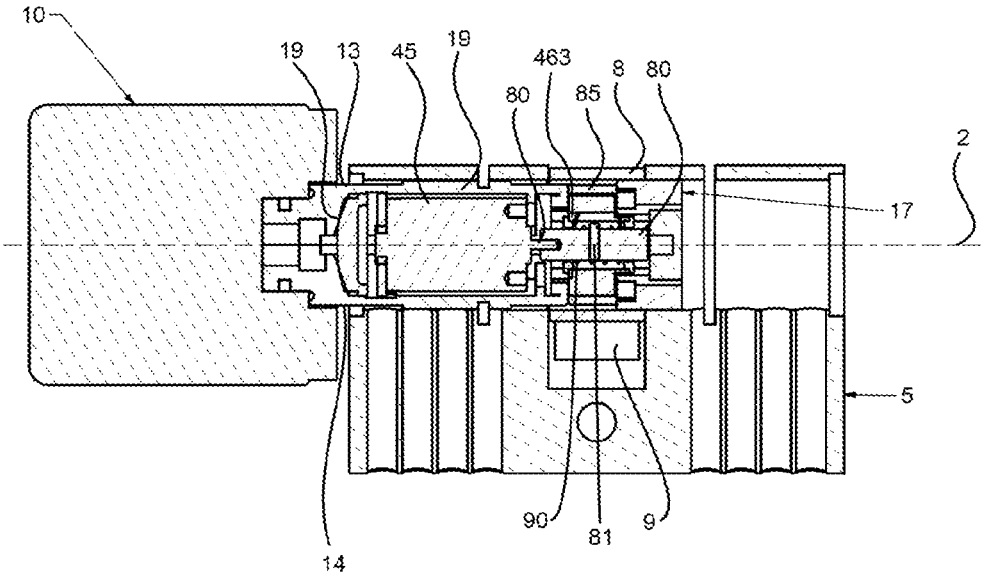
FIG. 5 shows a sectional view of a locking cylinder with an actuating element.
Figure 6:
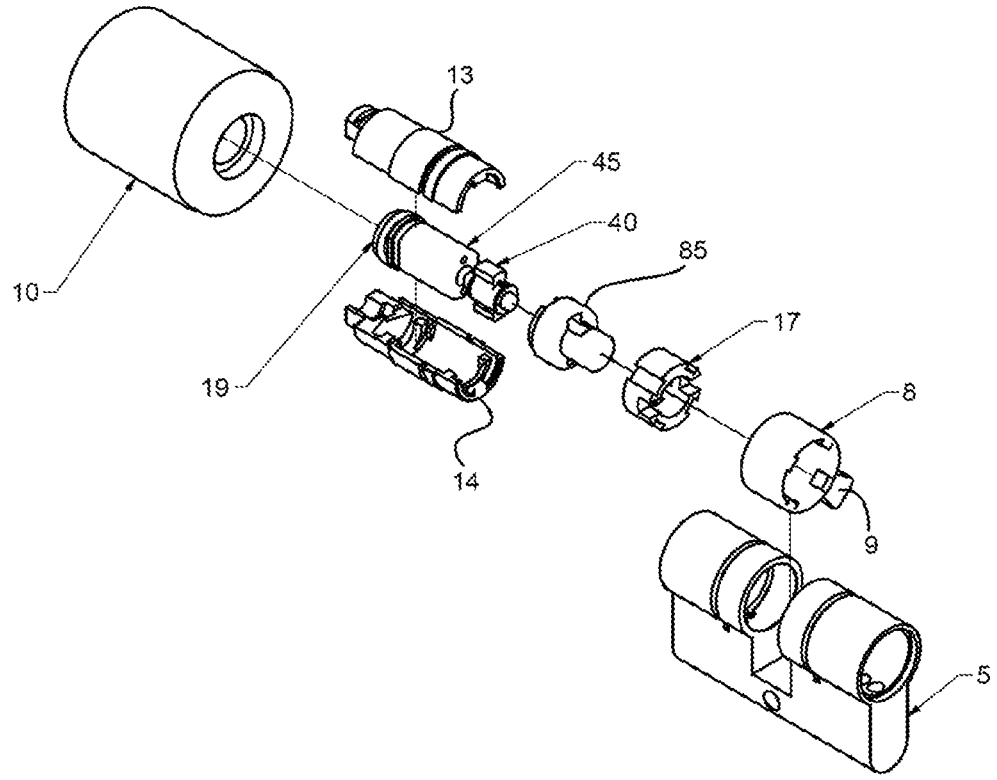
FIG. 6 shows an exploded view of the locking cylinder of FIG. 5.

FIGS. 5 and 6 show a locking cylinder 5 for actuating a mortise lock. For this purpose, the locking cylinder usually has a ring 8 with a locking cam, said ring 8 being rotatably mounted in the locking cylinder 5. Upon rotation of the ring 8, the locking cam 9 rotates for actuation of an entrainer for a latch and/or a dead bolt of a mortise lock.

The locking cylinder 5 preferably has a demountable knob module as an actuating element 1. The knob 10 serves as a handle 10 and is the input shaft of a clutch. For this purpose, a two-part drive block 46 is non-rotatably connected with the handle. The drive block 46 has a housing made of two half shells 13, 14 as a carrier and accommodates the motor 45 of the clutch. On the knob-side, the motor 45 is protected by a drill-safe protection 19, which is also (preferably rotatably) mounted in the drive block (cf. FIG. 6). The motor 45 has a rotor which is non-rotatably connected to a shaft 80. At the shaft 80, there is an entrainer 81 formed as a protrusion 81, which engages between two turns of a coil spring 90. The coil spring 90 is seated coaxially on the shaft 80 and engages with one of its ends 91 in a slot 463 of the drive carrier 46 being parallel to the longitudinal axis of the shaft 80. At the other end, there is a coupling element 40. The coupling element is fixed to the coil spring in a manner guaranteeing pressure resistance and tensile strength, e.g. by means of a rivet. The coupling element is mounted axially displaceable but non-rotatable relative to the drive carrier 46 in a guide 85. A rotation of the handle 10 about the longitudinal axis is thus transmitted via the drive carrier 46 to the coupling element 40, i.e. the coupling element rotates with the rotation of the handle 10, i.e. the guide 85 is non-rotatably connected to the drive carrier.

Due to the end engaging into the slot 463, the coil spring 90 is seated non-rotatable but axially displaceable in the drive carrier 46. If the shaft 80 is rotated by means of the motor 45, the protrusion 81 of the shaft 80 displaces the coil spring 90 forward or backward in the drive carrier 46, according to the rotation direction of the motor 45. The corresponding displacement of the coil spring 90 causes a corresponding displacement of the coupling element 40 through the slots of the guide 85 (cf. FIG. 6). If the coupling element 40 should be axially blocked, it would be biased in the corresponding direction and would release the bias as soon as the blockage is released.

By the displacement, the coupling element 40 can be brought into engagement with a coupling piece 17, which is seated non-rotatable in the locking cam ring 8; then the clutch is closed. The coupling piece 17 has the function of an output shaft of the clutch. For this purpose, the coupling piece 17 has protrusions or recesses between or in which the coupling element may engage when it is rotated accordingly upon rotation of the shaft 80. When the coupling element is rotated about the longitudinal axis 2, the locking cam ring 8 is thus entrained; the clutch is closed. Of course, the coupling piece 17 and the locking cam ring 8 may be formed in one piece. Notably, the coupling piece 17 is configured to operate in functionally-analogous or similar fashion to the manner in which the square shaft 17 of FIG. 1 operates.

If the coupling element 40 is retracted again by a corresponding rotation of the coil spring 90, the engagement between the coupling element 40 and the locking cam ring 8 is released, i.e. the clutch is reopened and an actuation of the handle 10 is not transmitted to the locking cam ring 8.

Figure 7:
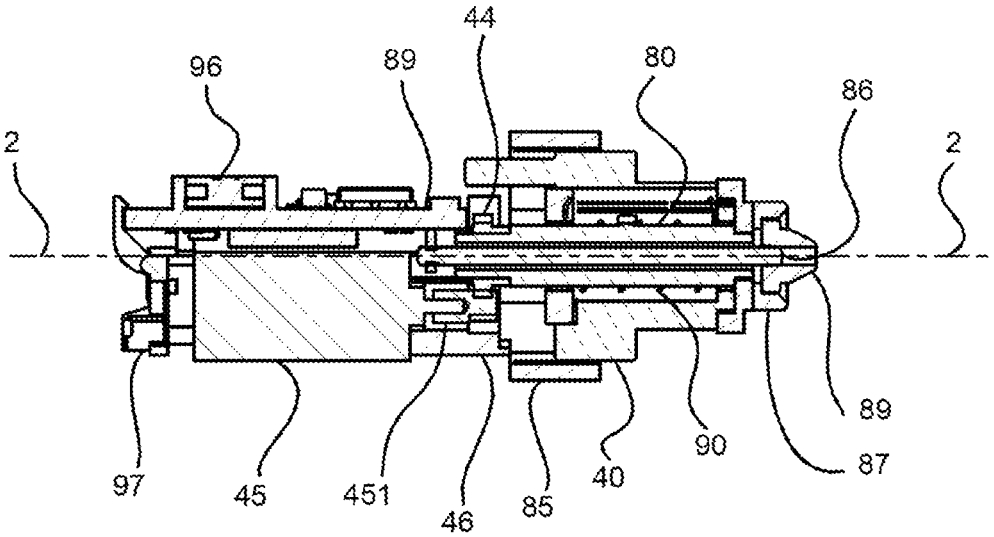
FIG. 7 shows a sectional view of a coupling assembly group.
Figure 8:
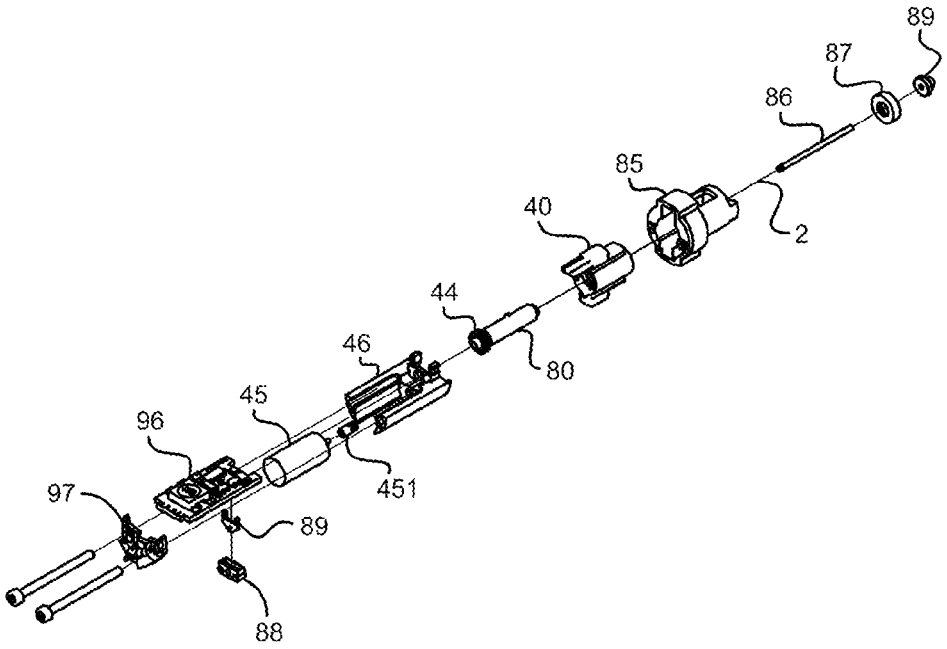
FIG. 8 shows an exploded view of the coupling assembly group of FIG. 7.

The linear drive illustrated in FIGS. 7 and 8 can be used, similar to the previously described, in a coupling assembly of a clutch for coupling of a handle (e.g. a knob) with a locking cam ring of a locking cylinder, or for coupling of a door handle with an output shaft. For identical or similar elements, largely identical reference numerals are used. The descriptions of FIGS. 1 to 6 may also be read on FIGS. 7 and 8.

Instead of the half shells 13, 14, the coupling assembly has a drive carrier 46 which holds the motor 45. Furthermore, a guide 85 for a coupling element 40 is attached to the drive carrier 46. In addition, the drive carrier 46 supports a printed circuit board 96 via a circuit carrier 97 with a circuit, e.g. for controlling the motor 45. Of course, the assembly shown in FIGS. 7 and 8 may be accommodated in a housing, e.g. of two half shells as shown in FIGS. 1 to 6.

Via a drive pinion 451, the motor 45 drives a shaft 80 being mounted at the drive carrier 46 and the guide 85. A gear wheel 44 seated on the shaft 80 engages with the drive pinion 46. The shaft has a radial protrusion 81 engaging between two turns of the coil spring 90 as already shown in the previously described embodiments. The coil spring 90 is seated axially displaceable on the shaft 80 and is mounted to the coupling element 40. The coupling element 40 is mounted axially displaceable relative to the shaft 80 in the guide 85 (i.e. similar as the coil spring 90 non-rotatable relative to the guide 85). For this purpose, the guide 85 has radial recesses extending axially, which serve as guiding slots for corresponding protrusions of the coupling element 40. Upon rotation of the shaft 80 about the longitudinal axis 2, the coil spring 90 and thus the coupling element 40 are displaced in the guide. By a corresponding control of the motor 45, the coupling element 40 can thus be moved forward or backward on the shaft 80. Upon corresponding displacement, the coupling element 40 can be brought into engagement with a coupling piece 17 (cf. FIGS. 5 and 6).

In the alternative according to FIGS. 7 and 8, the shaft 80 is embodied as a hollow shaft. A conductive pin 86 is arranged in the hollow shaft, wherein the conductive pin 86 is electrically isolated against the drive carrier 46, the hollow shaft 80, and the guide 85 by an air gap and an isolating shell 87 on the one hand and an isolating piece 88 on the other hand. On both ends of the pin 86 is one contact 89, respectively, such that via the carrier 46 and/or the guide 85 on the one hand, and the pin 97 on the other hand, a 'bifilar' electrical line can be established between to mutually movable knobs, and/or between a knob and the circuit on the drive carrier 46.

It will be appreciated to those skilled in the art having the benefit of this disclosure that this invention is believed to provide a door handle with an electromagnetic coupling. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

2 rotation axis/longitudinal axis
5 locking cylinder
8 locking cam ring
9 locking cam
10 handle
11 first leg
13 upper half shell
14 lower half shell
15 union nut
16 second leg
17, 17' output shaft (square shaft portion, coupling piece)

18 rosette
19 anti-drill protection
40 coupling element
44 gear wheel
45 motor
451 drive pinion
46 drive block or drive carrier
461 part of the drive block or drive carrier
462 part of the drive block or drive carrier
463 slot
464 channel (free space of the protrusion 465)
465 protrusion/sleeve
467 flange/edge bead
468 bearing bush
469 receptacle for gear wheel
80 auxiliary shaft, coupling shaft
81 protrusion
82 trunnion
83 bearing trunnion
85 guide
86 pin
87 isolating sleeve
88 isolation piece
89 contacts
90 coil spring
91 end/end section of the coil spring
92 end/end section of the coil spring
95 bearing ring/bearing sleeve
96 printed circuit board/circuit
97 circuit carrier

The invention claimed is:

1. An actuation element for a mortise lock of a door, the actuation element comprising:

an output shaft and a handle, the output shaft and the handle having a common rotation axis and being coupled to one another via an electromechanical clutch, an auxiliary shaft;

a coupling element;

a motor having a rotor and a stator, the motor configured to drive the auxiliary shaft;

a coil spring disposed on or in the auxiliary shaft, said coil spring being non-rotatable with respect to the stator of the motor and cooperated with the coupling element; and a drive carrier with a drive carrier recess and a slot that extends in an axial direction of the auxiliary shaft, wherein at least one end of the coil spring engages into said slot to form a linear bearing supporting the coil spring and the drive carrier recess is configured to receive the auxiliary shaft and the coil spring, wherein the output shaft has a recess at least on a side thereof that faces towards the handle, said recess dimensioned to accommodate the coupling element that is axially displaceable, in operation and due to displacement of the coil spring, between an open position and a closed position, the handle has a receptacle dimensioned to accommodate the coupling element opposite to the recess, the auxiliary shaft has at least one protrusion engaging in an intermediate space between two neighbored windings of the coil spring to displace the coil spring axially upon rotation of the auxiliary shaft, and the coil spring is connected to the coupling element to at least preload the coupling element in a direction of an axial displacement of the coil spring in response to said axial displacement.

2. The actuation element of claim 1, wherein the drive carrier has a plain bearing surface movably supporting the coupling element.

3. The actuation element of claim 1, wherein the drive carrier has at least two parts, said at least two parts providing the drive carrier recess and configured to secure the shaft in the drive carrier recess when the at least two parts are affixed together and to release the auxiliary shaft when the drive carrier is opened as a result of separating the at least two parts.

4. The actuation element of claim 1, further comprising at least one plain bearing bush supported by the drive carrier, said at least one plain bearing bush is configured to support the auxiliary shaft radially.

5. The actuation element of claim 1, further comprising a plain bearing sleeve positioned on the auxiliary shaft, said plain bearing sleeve forming a plain bearing in combination with the drive carrier.

6. The actuation element of claim 5, wherein the auxiliary shaft is tapered step-wise and abuts a step at a front side of the plain bearing sleeve to form a support for the auxiliary shaft in an axial direction.

7. Actuation element of claim 1, wherein the coil spring is cooperated with the coupling element in a push-pull manner.

8. An actuation element for a mortise lock of a door, the actuation element comprising:

an output shaft and a handle, the output shaft and the handle having a common rotation axis and being coupled to one another via an electromechanical clutch, an auxiliary shaft;

a coupling element;

a motor having a rotor and a stator and being configured to drive the auxiliary shaft;

a coil spring disposed on or in the auxiliary shaft in cooperation with the coupling element, said coil spring being non-rotatable with respect to the stator of the motor; and a drive carrier with a drive carrier recess configured to receive the auxiliary shaft and the coil spring, wherein a) the output shaft has a recess at least on a side thereof that faces towards the handle, said recess dimensioned to accommodate the coupling element that is axially displaceable, in operation, between an open position and a closed position, b) the handle has a receptacle dimensioned to accommodate the coupling element opposite to the recess, c) the auxiliary shaft has at least one protrusion engaging in an intermediate space between two neighbored windings of the coil spring to displace the coil spring axially upon rotation of the auxiliary shaft, d) the coil spring is connected to the coupling element to at least preload the coupling element in a direction of an axial displacement of the coil spring in response to said axial displacement, e) the drive carrier has a receptacle, the actuation element further comprising at least one gear wheel mounted on the auxiliary shaft and received, in operation, in said receptacle of the drive carrier, wherein at least a part of a boundary of the drive carrier recess supports the gear wheel in an axial direction.

9. The actuation element of claim 8, wherein the drive carrier has a slot extending in an axial direction of the auxiliary shaft, and wherein at least one end of the coil spring engages into said slot to form a linear bearing supporting the coil spring.

10. The actuation element of claim 8, wherein the drive carrier has a plain bearing surface movably supporting the coupling element.

11. The actuation element of claim 8, wherein the drive carrier has at least two parts, said at least two parts providing the drive carrier recess and securing the shaft in the drive carrier recess, the actuation element configured to release the auxiliary shaft in an axial direction when the drive carrier is opened as a result of separating the at least two parts.

12. The actuation element of claim 8, further comprising at least one plain bearing bush supported by the drive carrier, said at least one plain bearing bush is configured to support the auxiliary shaft radially.

13. The actuation element of claim 12, wherein the auxiliary shaft is tapered step-wise and abuts a step at a front side of a plain bearing sleeve to form a support for the auxiliary shaft in an axial direction.

14. The actuation element of claim 8, further comprising a plain bearing sleeve positioned on the auxiliary shaft, said plain bearing sleeve forming a plain bearing in combination with the drive carrier.

15. The actuation element of claim 14, wherein the auxiliary shaft is tapered step-wise and abuts a step at a front side of the plain bearing sleeve to form a support for the auxiliary shaft in an axial direction.

16. Actuation element of claim 8, wherein the coil spring is cooperated with the coupling element in a push-pull manner.

17. An actuation element for a mortise lock of a door, the actuation element comprising:

an output shaft and a handle, the output shaft and the handle having a common rotation axis and being coupled to one another via an electromechanical clutch, an auxiliary shaft;

a coupling element;

a motor having a rotor and a stator and being configured to drive the auxiliary shaft;

a coil spring disposed on or in the auxiliary shaft in cooperation with the coupling element, said coil spring being non-rotatable with respect to the stator of the motor;

a drive carrier with a drive carrier recess configured to receive the auxiliary shaft and the coil spring, wherein the output shaft has a recess at least on a side thereof that faces towards the handle, said recess dimensioned to accommodate the coupling element that is axially displaceable, in operation of the coil spring, between an open position and a closed position, the handle has a receptacle dimensioned to accommodate the coupling element opposite to the recess, the auxiliary shaft has at least one protrusion engaging in an intermediate space between two neighbored windings of the coil spring to displace the coil spring axially upon rotation of the auxiliary shaft, the coil spring is connected to the coupling element to at least preload the coupling element in a direction of an axial displacement of the coil spring in response to said axial displacement, and the actuation element further comprises a plain bearing sleeve positioned on the auxiliary shaft, said plain bearing sleeve forming a plain bearing in combination with the drive carrier, wherein the auxiliary shaft is tapered step-wise and abuts a step at a front side of the plain bearing sleeve to form a support for the auxiliary shaft in an axial direction.

18. The actuation element of claim 17, wherein the drive carrier has a slot extending in an axial direction of the auxiliary shaft, and wherein at least one end of the coil spring engages into said slot to form a linear bearing supporting the coil spring.

19. The actuation element of claim 17, wherein the drive carrier has a plain bearing surface movably supporting the coupling element.

20. The actuation element of claim 17, wherein the drive carrier has a receptacle and wherein the actuation element further comprises at least one gear wheel mounted on the auxiliary shaft and received, in operation, in said receptacle of the drive carrier, wherein at least a part of a boundary of the drive carrier recess supports the gear wheel in an axial direction.

21. The actuation element of claim 17, wherein the drive carrier has at least two parts, said at least two parts providing the drive carrier recess and securing the shaft in the drive carrier recess, the actuation element configured to release the auxiliary shaft in an axial direction when the drive carrier is opened as a result of separating the at least two parts.

22. Actuation element of claim 17, wherein the coil spring is cooperated with the coupling element in a push-pull manner.

* * * * *